United States Patent [19]

Lu

[11] Patent Number: 4,929,025

[45] Date of Patent: May 29, 1990

[54] SPRING-LOADED SEAT ASSEMBLY

[76] Inventor: Chin S. Lu, No. 50, Lane 262, Chen Hsing Rd., Taichung City, Taiwan

[21] Appl. No.: 419,676

[22] Filed: Oct. 11, 1989

[51] Int. Cl.[5] ..... A47C 7/02

[52] U.S. Cl. ..... 297/452; 267/133; 297/461; 297/DIG. 1; 297/DIG. 2

[58] Field of Search ..... 297/452, 458, 459, DIG. 1, 297/DIG. 2, 461, 462, 314; 248/620, 621; 267/133

[56] References Cited

U.S. PATENT DOCUMENTS

| | | | |
|---|---|---|---|
| 2,980,167 | 4/1961 | Harris et al. | 297/452 |
| 3,122,829 | 3/1964 | Schaad et al. | 297/452 X |
| 3,130,964 | 4/1964 | Johnson | 248/621 X |
| 3,393,012 | 7/1968 | Chancellor, Jr. | 297/452 X |
| 3,394,414 | 7/1968 | Unger | 297/452 X |
| 3,526,912 | 9/1970 | Lerman | 297/452 X |
| 4,555,141 | 11/1985 | Nemoto | 297/452 |
| 4,830,345 | 5/1989 | Mar | 297/314 |

*Primary Examiner*—Peter A. Aschenbrenner
*Attorney, Agent, or Firm*—Bernard R. Gans

[57] ABSTRACT

A spring-loaded seat assembly includes an upper seat and a lower seat connected by a plurality of spring members. A recess is formed on a respective outer surface of the upper and the lower seats. A number of hooks are provided on a respective inner surface of each seat for engaging both ends of the spring members so that the seats are resiliently connected together. A damping mechanism is provided between the upper and the lower seats so as to reduce the elasticity coefficient of the spring members. Therefore, the users may feel more comfortable.

4 Claims, 2 Drawing Sheets

SPRING-LOADED SEAT ASSEMBLY

FIELD OF THE INVENTION

The present invention relates to a seat assembly, and more particularly to a spring-loaded seat assembly.

BACKGROUND OF THE INVENTION

The closest prior art of which the inventor is aware is the U.S. Pat. No. 4,830,345 (Shih L. Mar, "spring-loaded seat assembly", Ser. No. 122,441, filed Nov. 19, 1987). The spring-loaded seat assembly disclosed is a cushion having two circular seat pieces with a plurality of coil spring members connecting the two seat pieces. The upper circular seat piece is capable of vibrating and oscillating up and down for exercising purposes. The coil spring members vibrate and oscillate freely. Since the elasticity coefficient and the oscillation amplitude of the spring members are very large, the seat assembly may cause injury to old or very young people. In addition, the spring members are apt to be biased and distorted, which may further cause injury to the users, especially to the waist portions of the users.

The present invention has arisen to mitigate and/or obviate the afore described disadvantages of the conventional spring-loaded seat assembly.

SUMMARY OF THE INVENTION

The primary objective of the present invention is to provide a spring-loaded seat assembly which has a damping mechanism provided for diminishing the oscillation of the spring members.

The present invention seeks to provide a spring-loaded seat assembly which includes an upper seat and a lower seat connected by a plurality of spring members. A recess is formed on a respective outer surface of the upper and the lower seats. A number of hooks are provided on a respective inner surface of each seat for engaging both ends of the spring members so that the seats are resiliently connected together. A damping mechanism is provided between the upper and the lower seats so as to reduce the elasticity coefficient of the spring members. Therefore, the users may feel more comfortable.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
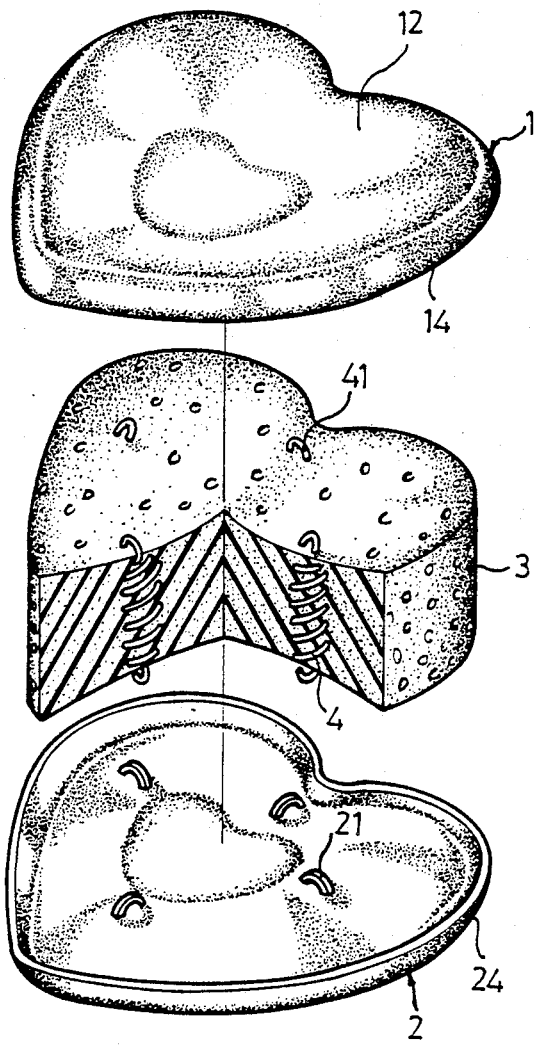
FIG. 1 is an exploded view of a spring-loaded seat assembly in accordance with the present invention.

Referring to the drawings and initially to FIG. 1, the spring-loaded seat assembly in accordance with the present invention comprises generally an upper seat 1 and a lower seat 2 with a plurality of spring members 4 connected therebetween.

The upper and the lower seats 1, 2 are substantially heart shaped with a recess 12, 22 formed on the respective outer surfaces of the upper and the lower seats 1, 2. The recesses 12, 22 are also substantially heart shaped which matches the ergonomics of the user to maximize comfort for the user sitting on the seat assembly in accordance with the present invention. A number of hooks 11, 21 are formed on the respective inner surfaces of the seats 1, 2 for engaging the ends 41 of the spring members 4 so that the seats 1, 2 are resiliently connected together. A peripheral flange 14, 24 is formed on the respective outer peripheral surface of each of the seats and extend vertically toward each other. A porous material 3, such as sponge, foam materials or the like, is provided between the two seats 1, 2 and acts as a damping mechanism.

Figure 2:
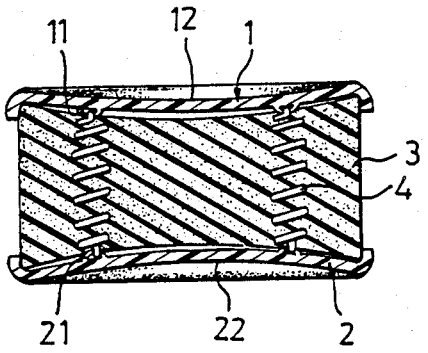
FIG. 2 is a cross sectional view of the spring-loaded seat assembly of FIG. 1.
Figure 3:
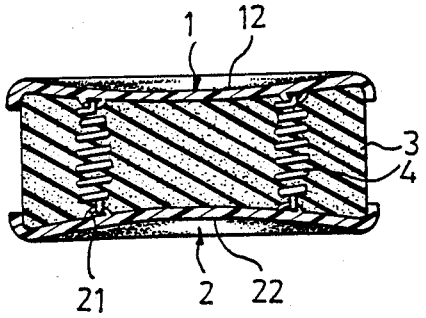
FIG. 3 is a cross sectional view similar to FIG. 2 showing a working position.

Referring next to FIGS. 2 and 3, when the seat assembly in accordance with the present invention is not in a condition of use (FIG. 2), the spring members 4 are extended and the porous material 3 is expanded so that the porous material 3 fills with air. When an external force is applied on the upper surface of the upper seat 1, such as the sitting of a person, both the spring members 4 and the porous material 3 absorb the external force and are compressed (FIG. 3). The porous material 3 diminishes the rate of extension and retraction of the spring members 4 so that the upper seat 1 moves up and down with a gentle motion relative to the lower seat 2. Therefore, the user may feel more comfortable. In addition, the porous material 3 prevents the spring members and the upper seat 1 from becoming distorted.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A spring-loaded seat assembly comprising an upper seat and a lower seat with a plurality of spring members connected therebetween; a recess being formed on a respective outer surface of said upper and said lower seats; a number of hooks being formed on a respective inner surface of said seats for engaging both ends of said spring members so that said seats are resiliently connected together; a peripheral flange being formed on a respective inner peripheral surface of each said seat and extending vertically toward each other; and a damping mechanism being provided between said seats.

2. A seat assembly according to claim 1, wherein said upper and said lower seats are heart shaped.

3. A seat assembly according to claim 1, wherein said recesses on said upper and said lower seats are heart shaped.

4. A seat assembly according to claim 1, wherein said damping mechanism is a porous material.

* * * * *